US011192376B2

(12) United States Patent
Sugiyama

(10) Patent No.: US 11,192,376 B2
(45) Date of Patent: Dec. 7, 2021

(54) WIPING ASSEMBLY FOR LIQUID EJECTION HEAD AND INK JET PRINTER

(71) Applicant: Roland DG Corporation, Hamamatsu (JP)

(72) Inventor: Yuichi Sugiyama, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/671,208

(22) Filed: Nov. 1, 2019

(65) Prior Publication Data

US 2020/0164649 A1 May 28, 2020

(30) Foreign Application Priority Data

Nov. 28, 2018 (JP) ..... JP2018-221974

(51) Int. Cl.
*B41J 2/165* (2006.01)

(52) U.S. Cl.
CPC ..... *B41J 2/16535* (2013.01)

(58) Field of Classification Search
CPC . B41J 2/16544; B41J 2/16541; B41J 2/16535
See application file for complete search history.

(56) References Cited

U.S. PATENT DOCUMENTS 5,815,176 A * 9/1998 Rotering ..... B41J 2/16547 347/24
5,969,731 A * 10/1999 Michael ..... B41J 2/16535 347/33
6,454,385 B1 * 9/2002 Anderson ..... B41J 2/16538 347/28
6,530,643 B1 * 3/2003 Askren ..... B41J 2/16535 347/33
2009/0179953 A1 7/2009 Hibbard et al.
2017/0253045 A1 * 9/2017 Hirabayashi ..... B41J 2/16538

FOREIGN PATENT DOCUMENTS

JP 2002-240308 A 8/2002
JP 2005-212351 A 8/2005
JP 2006-142702 A 6/2006
JP 2013-188965 A 9/2013
JP 2016-068503 A 5/2016
JP 2016-215427 A 12/2016

* cited by examiner

*Primary Examiner* — Lam S Nguyen
(74) *Attorney, Agent, or Firm* — Keating & Bennett, LLP

(57) ABSTRACT

A wiping assembly includes a wiper that wipes a liquid ejection head, a wiper cleaner, and a mover that moves the wiper relative to the wiper cleaner. The wiper cleaner includes a first member, a second member, an absorbent, and a presser. An opening is located in the first member. The second member includes a projecting portion opposed to the opening. The absorbent has a plate shape and is disposed between the first member and the second member. The presser presses the second member toward the first member. The projecting portion presses the absorbent toward the opening. A portion of the absorbent is deformed to form a protruding portion that protrudes in a projection direction of the projecting portion from the opening by pressing by the projecting portion. The mover moves the wiper such that the wiper contacts the protruding portion of the absorbent.

12 Claims, 8 Drawing Sheets

WIPING ASSEMBLY FOR LIQUID EJECTION HEAD AND INK JET PRINTER

CROSS REFERENCE TO RELATED APPLICATIONS

This application claims the benefit of priority to Japanese Patent Application No. 2018-221974 filed on Nov. 28, 2018. The entire contents of this application are hereby incorporated herein by reference.

BACKGROUND OF THE INVENTION

1. Field of the Invention

The present invention relates to a wiping assembly for a liquid ejection head and an ink jet printer including the wiping assembly.

2. Description of the Related Art

Conventionally, liquid ejection devices including a wiper that wipes a liquid ejection head and a wiper cleaner that cleans the wiper have been known. For example, Japanese Laid-open Patent Publication No. 2013-188965 discloses an ink jet printer including a wiper that wipes an ink head and a wiper cleaner that cleans the wiper. As described in Japanese Laid-open Patent Publication No. 2013-188965, in general, the wiper is formed of a flexible material. When the wiper is cleaned, the wiper is pressed against a contact surface of the wiper cleaner formed of an absorbent that absorbs an ink and is curved by the pressing force. Therefore, the wiper cleaner disclosed in Japanese Laid-open Patent Publication No. 2013-188965 has contact surfaces that form a stereoscopic shape suitable for cleaning the curved wiper.

In the ink jet printer disclosed in Japanese Laid-open Patent Publication No. 2013-188965, in order to form the contact surfaces that form a stereoscopic shape, an absorbent having a plate shape is formed to copy wall surfaces molded into a desired stereoscopic shape and the absorbent is fixed in the above described state. However, in view of shape accuracy required for the contact surfaces, it is an excessive elaboration to form the wall surfaces on which the absorbent is formed to copy a desired stereoscopic shape and provide a fixing member that fixes the absorbent to the wall surfaces.

SUMMARY OF THE INVENTION

In view of the foregoing, preferred embodiments of the present invention provide wiping assemblies for liquid ejection heads in each of which an absorbent of a wiper cleaner having a plate shape is able to be easily formed into a stereoscopic shape.

A wiping assembly for a liquid ejection head disclosed herein includes a wiper to wipe a liquid ejection head, a wiper cleaner, and a mover to move the wiper relative to the wiper cleaner. The wiper cleaner incudes a first member, a second member, an absorbent, and a presser. An opening is provided in the first member. The second member includes a projecting portion opposed to the opening. The absorbent has a plate shape and is disposed between the first member and the second member. The absorbent is formed of a material that can absorb a liquid ejected by the liquid ejection head and is flexible. The presser is able to press the second member toward the first member. The second member is positioned such that the projecting portion presses the absorbent toward the opening of the first member in a state in which the second member is pressed by the presser. At least a portion of the absorbent is deformed to provide a protruding portion that protrudes in a projection direction of the projecting portion from the opening by pressing by the projecting portion. The mover moves the wiper such that the wiper contacts the protruding portion of the absorbent.

According to the wiping assembly for a liquid ejection head, the flexible absorbent having a plate shape is pressed and bent by the projecting portion of the second member and protrudes from the opening of the first member. The protruding portion of the absorbent has a projecting stereoscopic shape suitable for cleaning of the wiper. Therefore, according to the above described wiping assembly, the absorbent of the wiper cleaner, which has a plate shape, is able to be easily formed into a stereoscopic shape.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

With reference to the attached drawings, ink jet printers according to preferred embodiments will be described below. Note that, as a matter of course, preferred embodiments described herein are not intended to be particularly limiting of the present invention. Also, members and portions that have the same function are denoted by the same reference symbol and redundant description will be omitted or simplified, as appropriate.

Figure 1:
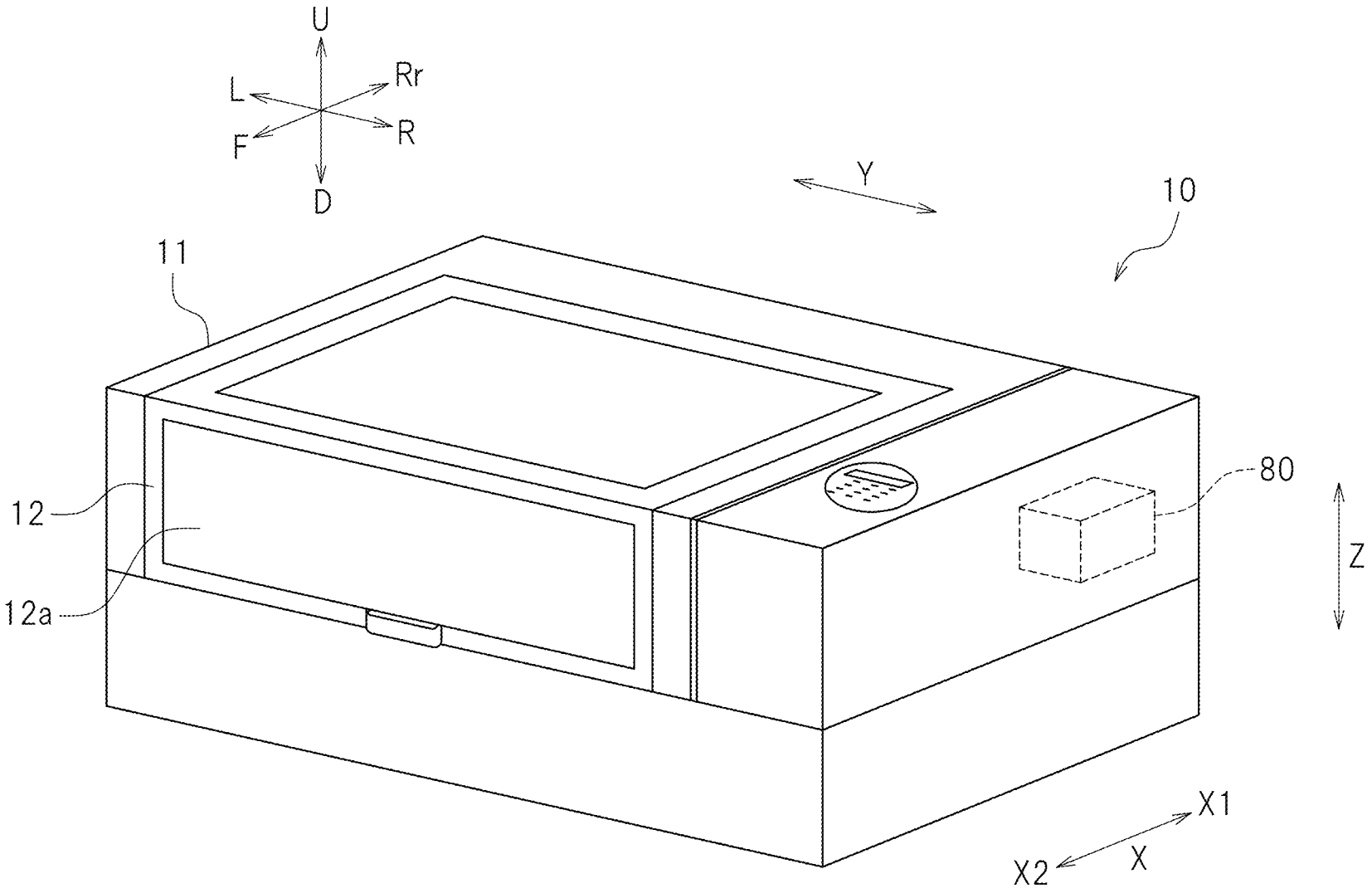
FIG. 1 is a perspective view of a printer according to a preferred embodiment of the present invention.

FIG. 1 is a perspective view of an ink jet printer (which will be hereinafter referred to as a printer) 10 according to a preferred embodiment of the present invention. In the following description, unless specifically stated otherwise, when the printer 10 is viewed from front, a direction away from the printer 10 is a forward direction and a direction approaching the printer 10 is a rearward direction. Left, right, up, and down mean left, right, up, and down when the printer 10 is viewed from front, respectively. Reference symbols F, Rr, L, R, U, and D in the drawings indicate front, rear, left, right, up, and down, respectively. Note that these directions are used herein merely for convenience of description, do not limit setting modes of the printer 10, and do not limit the present invention.

The reference symbol Y as used in the drawings denotes a main scanning direction. The main scanning direction Y is a left-right direction in this preferred embodiment. The reference symbol X denotes a sub scanning direction. The sub scanning direction X is a front-rear direction in this preferred embodiment. The reference symbol Z denotes an up-down direction. The main scanning direction Y, the sub scanning direction X, and the up-down direction Z are perpendicular to each other. Note that there is no particular limitation on the main scanning direction Y, the sub scanning direction X, and the up-down direction Z. The main scanning direction Y, the sub scanning direction X, and the up-down direction Z can be appropriately set in accordance with a configuration of the printer 10.

In this preferred embodiment, the printer 10 is an ink jet printer. In this preferred embodiment, an "ink jet system" includes various known ink jet systems including various continuous methods, such as a binary deflection method, a continuous deflection method, or the like, and various on-demand methods, such as a thermal method, a piezoelectric method, or the like.

Figure 2:
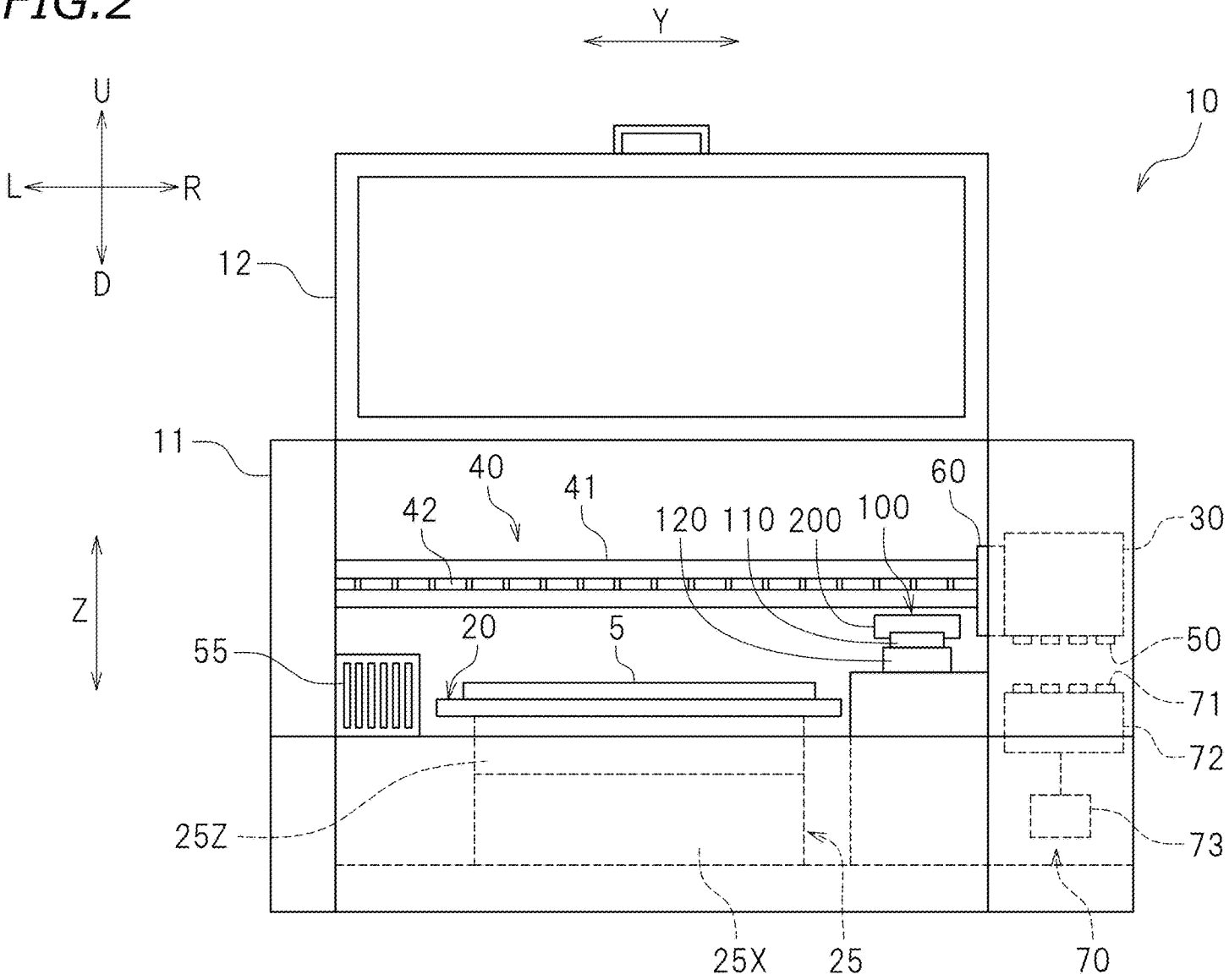
FIG. 2 is a front view of the printer in a state in which a front cover is opened.

As illustrated in FIG. 1, the printer 10 is formed into a box shape. In this preferred embodiment, the printer 10 includes a case 11 and a front cover 12. FIG. 2 is a front view of the printer 10 in a state in which the front cover 12 is opened. As illustrated in FIG. 2, an opening is located in a front portion of the case 11. The front cover 12 is provided so as to be able to open and close an opening of the case 11. In this preferred embodiment, the front cover 12 is supported by the case 11 so as to be rotatable about a rear end thereof as an axis. A window 12*a* is provided in the front cover 12. The window 12*a* is formed of, for example, a transparent acryl plate. A user is able to view an internal space of the case 11 through the window 12*a*.

As illustrated in FIG. 2, a table 20, a table mover 25, a carriage 30, a carriage mover 40, a plurality of ink heads 50, a light irradiator 60, a capping assembly 70, a controller 80 (see FIG. 1), and a wiping assembly 100 are provided in the internal space of the printer 10.

A recording medium 5 is placed on the table 20. The printer 10 according to this preferred embodiment is a so-called flatbed printer. The table 20 is disposed substantially in a center in the internal space of the case 11 in the main scanning direction Y. The table 20 has a plate shape. The table 20 is set such that planar surfaces face in an up-down direction Z. Although not illustrated, a plurality of holes through which the recording medium 5 is sucked and is fixed are provided in the table 20. The plurality of holes pass through the table 20 in the up-down direction. For example, a fan (not illustrated) is installed under the table 20. The fan draws in air from the plurality of holes to suck the recording medium 5. There is no particular limitation on a shape of the recording medium 5. The recording medium 5 may have various stereoscopic shapes, in addition to a plate shape. Also, there is no particular limitation on a material of the recording medium 5. The recording medium 5 may be formed of, for example, wood, metal, glass, paper, fabric, or the like.

The table mover 25 is disposed under the table 20. The table mover 25 moves the table 20 in the sub scanning direction X and the up-down direction Z. The table 20 is supported by the table mover 25 from below. The table mover 25 includes a sub scanning direction mover 25X and an up-down direction mover 25Z. The up-down direction mover 25Z supports the table 20 and moves the table 20 in the up-down direction Z. In this preferred embodiment, the up-down direction mover 25Z includes a ball screw mechanism (not illustrated). The ball screw mechanism is driven by a Z-axis direction motor (not illustrated). The up-down direction mover 25Z is supported by the sub scanning direction mover 25X from below. The sub scanning direction mover 25X supports the up-down direction mover 25Z and moves the up-down direction mover 25Z in the sub scanning direction X. In this preferred embodiment, the sub scanning direction mover 25X includes a ball screw mechanism (not illustrated). The ball screw mechanism is driven by an X-axis direction motor (not illustrated). However, there is no limitation on a configuration of the table mover 25. For example, the mechanisms that drive the sub scanning direction mover 25X and the up-down direction mover 25Z may not be ball screw mechanisms. Power of each of the sub scanning direction mover 25X and the up-down direction mover 25Z may not be motor power. An upper and lower positional relation of the sub scanning direction mover 25X and the up-down direction mover 25Z may be reversed. The X-axis direction motor and the Z-axis direction motor of the table mover 25 are electrically connected to the controller 80 and are controlled by the controller 80.

The carriage 30 includes the plurality of ink heads 50 and the light irradiator 60 mounted thereon. The carriage 30 is provided above the table 20 and is movable in the main scanning direction Y. The carriage 30 is moved by the carriage mover 40. The carriage mover 40 moves the carriage 30 in the main scanning direction Y. The carriage mover 40 includes a guide rail 41, a belt 42, left and right pullies (not illustrated), and a Y-axis direction motor (not illustrated).

The guide rail 41 guides the carriage 30 in the main scanning direction Y. As illustrated in FIG. 2, the guide rail 41 extends in the main scanning direction Y. The carriage 30 slidably engages the guide rail 41.

An endless belt 42 is fixed to the carriage 30. The belt 42 is wound around the pullies provided at left and right of the guide rail 41. The Y-axis direction motor is attached to one of the pullies. The Y-axis direction motor is electrically connected to the controller 80 and is controlled by the controller 80. When the Y-axis direction motor is driven, the pullies rotate and the belt 42 runs. Accordingly, the carriage 30 moves along the guide rail 41 in the main scanning direction Y.

Figure 3:
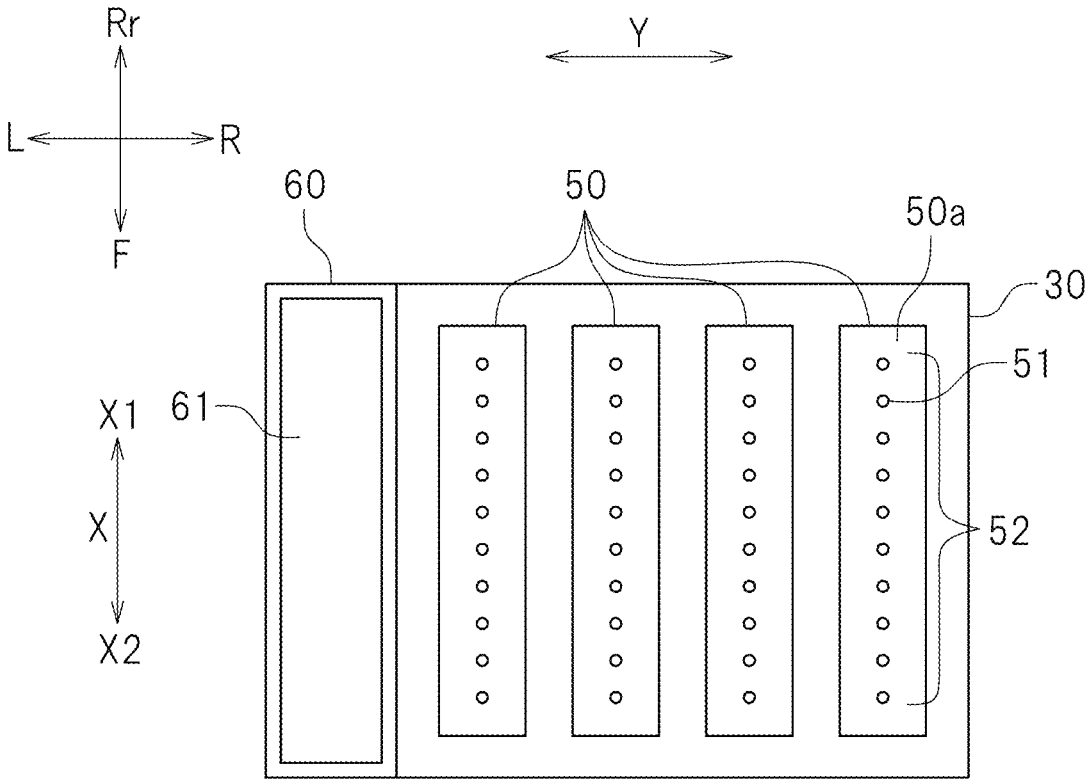
FIG. 3 is a plan view schematically illustrating a configuration of a lower surface of a carriage.

The plurality of ink heads 50 are mounted on the carriage 30. In this preferred embodiment, the plurality of ink heads 50 are provided on a lower surface of the carriage 30. FIG. 3 is a plan view schematically illustrating a configuration of the lower surface of the carriage 30. As illustrated in FIG. 3, the plurality of ink heads 50 are disposed in a line in the main scanning direction Y. Each of the plurality of ink heads 50 extends in the sub scanning direction X.

Each of the plurality of ink heads 50 includes a plurality of nozzles 51 disposed in a line in the sub scanning direction X. Each of the nozzles 51 is a fine hole through which an ink is ejected. The plurality of nozzles 51 are located on lower surfaces of the ink heads 50. The lower surfaces of the ink heads 50 define nozzle surfaces 50*a* on which the plurality of nozzles 51 are located. In each of the ink heads 50, the plurality of nozzles 51 are positioned in a line in the sub scanning direction X to define a nozzle array 52. The nozzle array 52 extends in the sub scanning direction X. Note that the number of the nozzle arrays 52 in each of the ink heads 50 is one in this preferred embodiment, but may be two or more. In FIG. 3, the number of nozzles 51 that define the nozzle array 52 is ten but, actually, much more than ten nozzles (for example, 300 nozzles) are preferably provided. There is no particular limitation on the number of the nozzles 51 that define the nozzle array 52.

Each of the nozzles 51 communicates with a pressure chamber in which the ink is stored. The ink is ejected from each of the nozzles 51 by expansion and contraction of the pressure chamber, for example, by driving of a piezoelectric element or the like. The piezoelectric element or the like is electrically connected to the controller 80 and is controlled by the controller 80.

An ink cartridge 55 (see FIG. 2) is connected to each of the plurality of ink heads 50 via an ink tube (not illustrated). Respective different ink cartridges 55 are connected to the plurality of ink heads 50. In this preferred embodiment, each of inks ejected from the ink heads 50 is a photo curable ink. The photo curable ink is an ultraviolet curing ink which is cured by the irradiation with an ultraviolet ray herein. There is no particular limitation on components, characteristics, or the like of the photo curable ink. Also, there is no limitation on colors of the inks that are ejected. The inks that are ejected from the plurality of ink heads 50 are, for example, process color inks of CMYK or spot color inks, such as a clear ink, a white ink, or the like.

As illustrated in FIG. 3, the light irradiator 60 is provided in the carriage 30. The light irradiator 60 radiates light that cures the photo curable ink. The light irradiator 60 includes a light source (not illustrated) and a light irradiation port 61. The light irradiator 60 radiates light downwardly from the light irradiation port 61. The light irradiator 60 extends in the sub scanning direction X. The light irradiator 60 is disposed at a left side of the ink heads 50 herein. However, the light irradiator 60 may be disposed at a right side of the carriage 30. As another option, the light irradiator 60 may be provided at each of the left and right sides. The light irradiator 60 is electrically connected to the controller 80 and is controlled by the controller 80.

As illustrated in FIG. 2, the capping assembly 70 is provided near a right end of the printer 10. The carriage mover 40 is able to move the carriage 30 to a position over the capping assembly 70. As illustrated in FIG. 2, the capping assembly 70 includes a plurality of caps 71, a cap mover 72, and a suction pump 73.

Each of the plurality of caps 71 is attachable to the nozzle surface 50*a* of one corresponding ink head 50. The number of the caps 71 that are provided is the same as the number of the ink heads 50. The plurality of caps 71 are positioned in a line in the main scanning direction Y. Each of the caps 71 has a bottomed box shape having an opened upper side. Each of the plurality of caps 71 is preferably made of, for example, rubber or the like. When the caps 71 are attached to the ink heads 50, the caps 71 adhere to the nozzle surfaces 50*a* of the ink heads 50 and the nozzle surfaces 50*a* are covered by the caps 71. The caps 71 are attached to the ink heads 50, and thus, protect the ink heads 50. Also, the caps 71 protect the nozzles 51 and the nozzle surfaces 50*a* from drying.

The cap mover 72 movably supports the plurality of caps 71 in the up-down direction. The cap mover 72 lifts the caps 71 and attaches the caps 71 to the ink heads 50. The cap mover 72 also lowers the caps 71 and separates the caps 71 from the ink heads 50. The cap mover 72 includes, for example, a ball screw mechanism and a driving motor. When the driving motor is driven, the caps 71 are moved in the up-down direction by the ball screw mechanism.

Each of the plurality of suction pumps 73 is connected to one corresponding cap 71. The number of the suction pumps 73 that are provided is the same as the number of the caps 71. The suction pumps 73 suck the inks stored in the caps 71. The suction pumps 73 are, for example, tube pumps. Each of the plurality of suction pumps 73 is connected to a bottom portion of the corresponding cap 71 via a tube or the like. When the suction pumps 73 are driven in a state in which the caps 71 are attached to the ink heads 50, the inks are sucked out from the nozzles 51 of the ink heads 50. The inks sucked by the suction pumps 73 are discarded into a waste liquid tank (not illustrated) via tubes (not illustrated) or the like.

Figure 4:
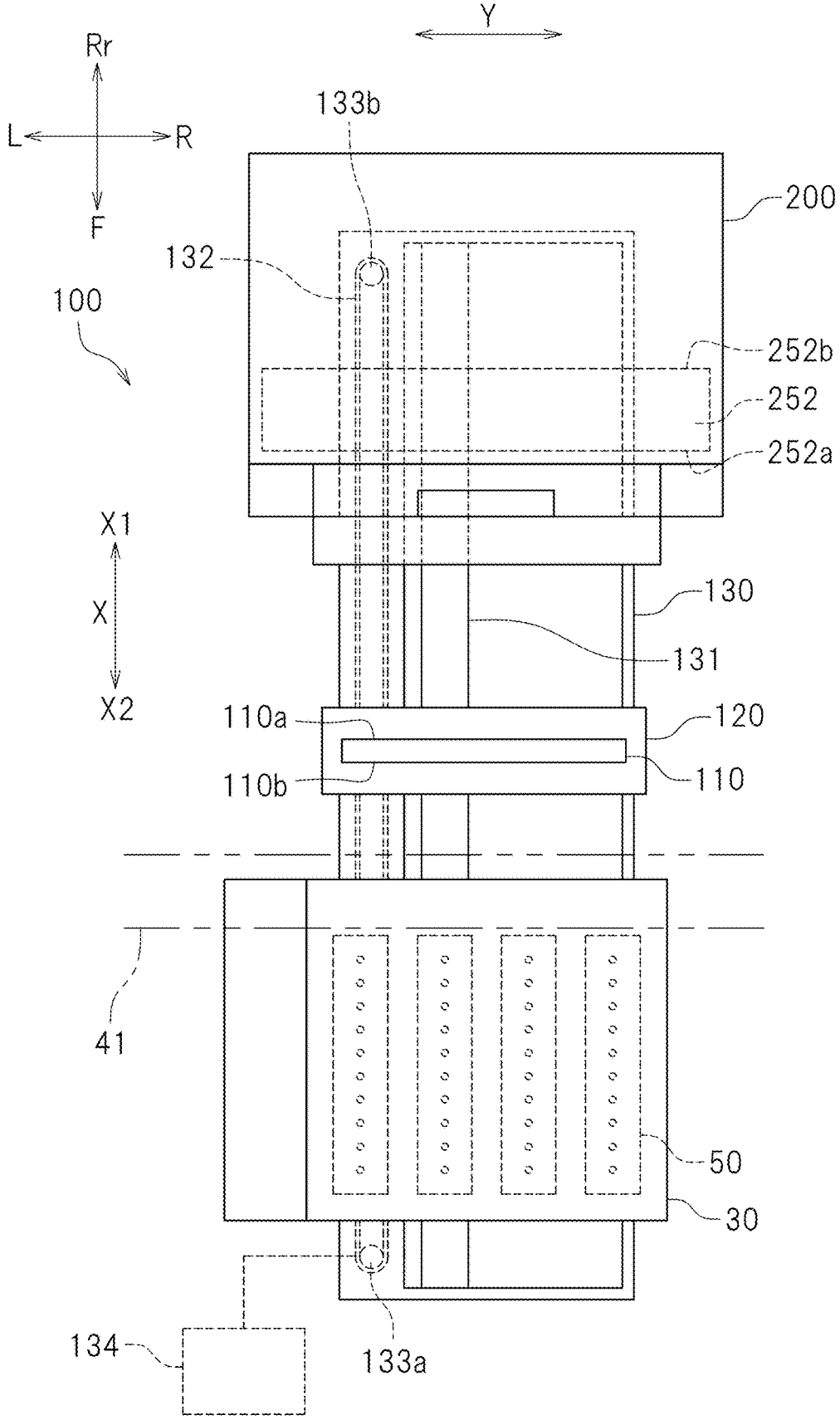
FIG. 4 is a plan view schematically illustrating a configuration of a wiping assembly.
Figure 5:
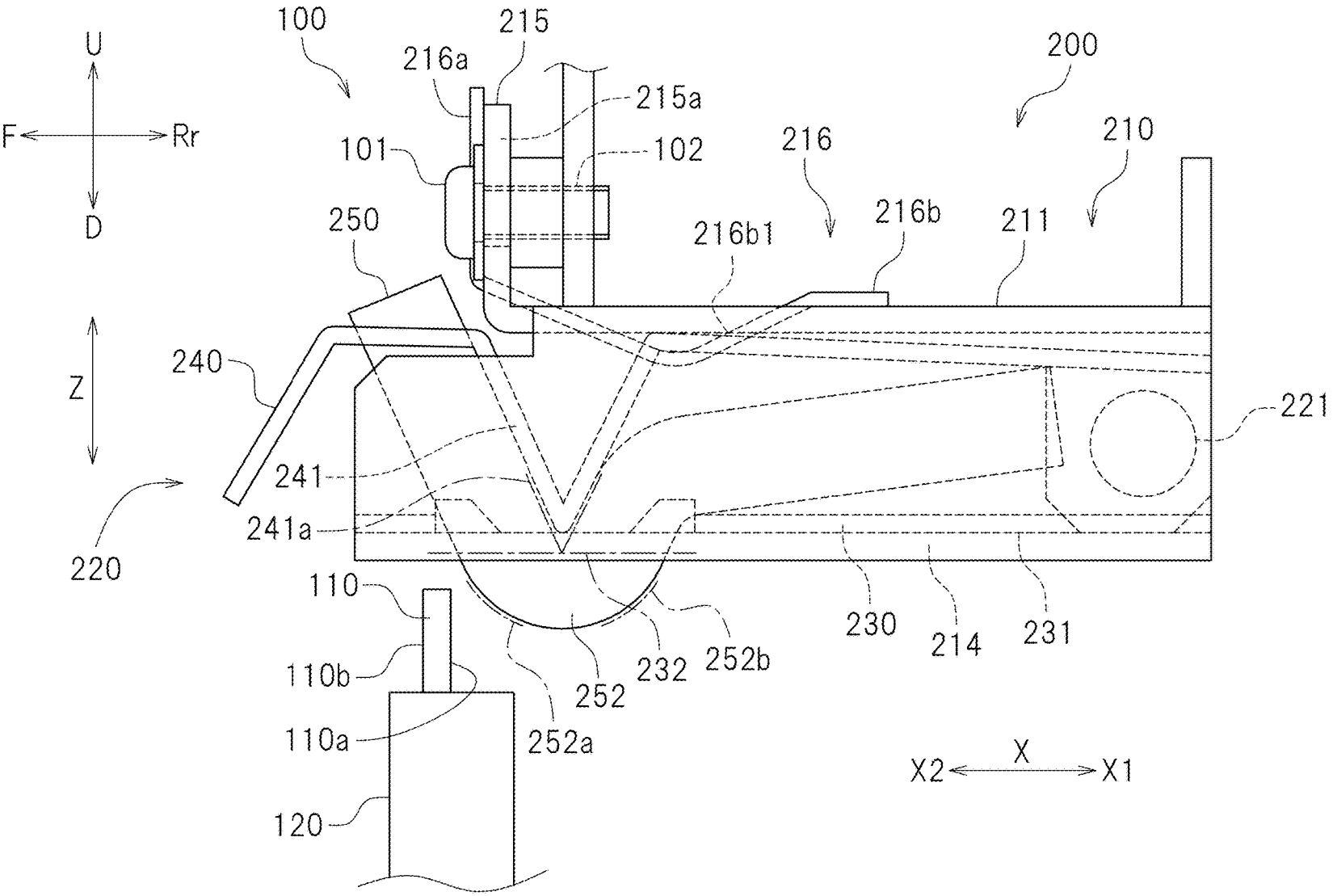
FIG. 5 is a side view of the wiping assembly when viewed from right.

As illustrated in FIG. 2, in this preferred embodiment, the wiping assembly 100 is provided at a left side of the capping assembly 70. FIG. 4 is a plan view schematically illustrating a configuration of the wiping assembly 100. FIG. 5 is a side view of the wiping assembly 100 when viewed from right. As illustrated in FIG. 4 and FIG. 5, the wiping assembly 100 includes a wiper 110, a wiper mover 130, and a wiper cleaner 200.

The wiper 110 is able to wipe the nozzle surfaces 50*a* of the ink heads 50. As illustrated in FIG. 4 and FIG. 5, the wiper 110 has a plate shape. The wiper 110 is preferably made of a flexible material, such as, for example, rubber. The wiper 110 extends in the main scanning direction Y and the up-down direction Z. The wiper 110 has a predetermined width in the main scanning direction Y. The wiper 110 has a predetermined height in the up-down direction Z. The main scanning direction Y will be hereinafter also referred to as a width direction Y of the wiper 110.

The wiper 110 is held by a wiper holder 120. The wiper holder 120 grips a lower end of the wiper 110. The wiper 110 is held by the wiper holder 120 and substantially stands upright. Although not illustrated, an upper end of the wiper 110 is located slightly above the nozzle surfaces 50*a* of the ink heads 50. Therefore, a portion of the wiper 110 near the upper end overlaps the ink heads 50 in the up-down direction.

As illustrated in FIG. 4, the wiper 110 and the wiper holder 120 are located behind the guide rail 41 when not being used. The wiper mover 130 moves the wiper 110 and the wiper holder 120 in the sub scanning direction X. The sub scanning direction X will be hereinafter also referred to as a moving direction X of the wiper 110. The moving direction X of the wiper 110 is perpendicular to the width direction Y of the wiper 110. In the moving direction X of the wiper 110, the rearward direction will be hereinafter also referred to as a first moving direction X1, and the forward direction will be hereinafter also referred to as a second moving direction X2. The wiper mover 130 is able to move the wiper 110 to a position farther in the second moving direction X2 than the guide rail 41 and is able to move the wiper 110 back to a position farther in the first moving direction X1 than the guide rail 41. The wiper mover 130 includes a guide rail 131, a belt 132, front and rear pullies 133*a* and 133*b*, and a driving motor 134.

The guide rail 131 extends in the moving direction X of the wiper 110. The wiper holder 120 engages the guide rail 131. The wiper holder 120 and the wiper 110 held by the wiper holder 120 are movable along the guide rail 131 in the moving direction X. The endless belt 132 is fixed to the wiper holder 120. The belt 132 is wound around the front side pully 133*a* and the rear side pully 133*b* of the guide rail 131. The driving motor 134 is attached to the front side pully 133*a*. The driving motor 134 is electrically connected to the controller 80 and is controlled by the controller 80. When the driving motor 134 is driven, the pully 133*a* rotates and the belt 132 runs. Thus, the wiper 110 moves along the guide rail 131 in the moving direction X.

The wiper cleaner 200 is provided behind the wiper 110 when not being used. The wiper cleaner 200 is provided in a line with the wiper 110 in the moving direction X of the wiper 110. The wiper cleaner 200 is disposed in a movable range of the wiper 110. Therefore, the wiper mover 130 is able to move the wiper 110 to a position farther in the first moving direction X1 and a position farther in the second moving direction X2 than cleaning surfaces 252*a* and 252*b* of the wiper cleaner 200 (see FIG. 5).

Figure 6:
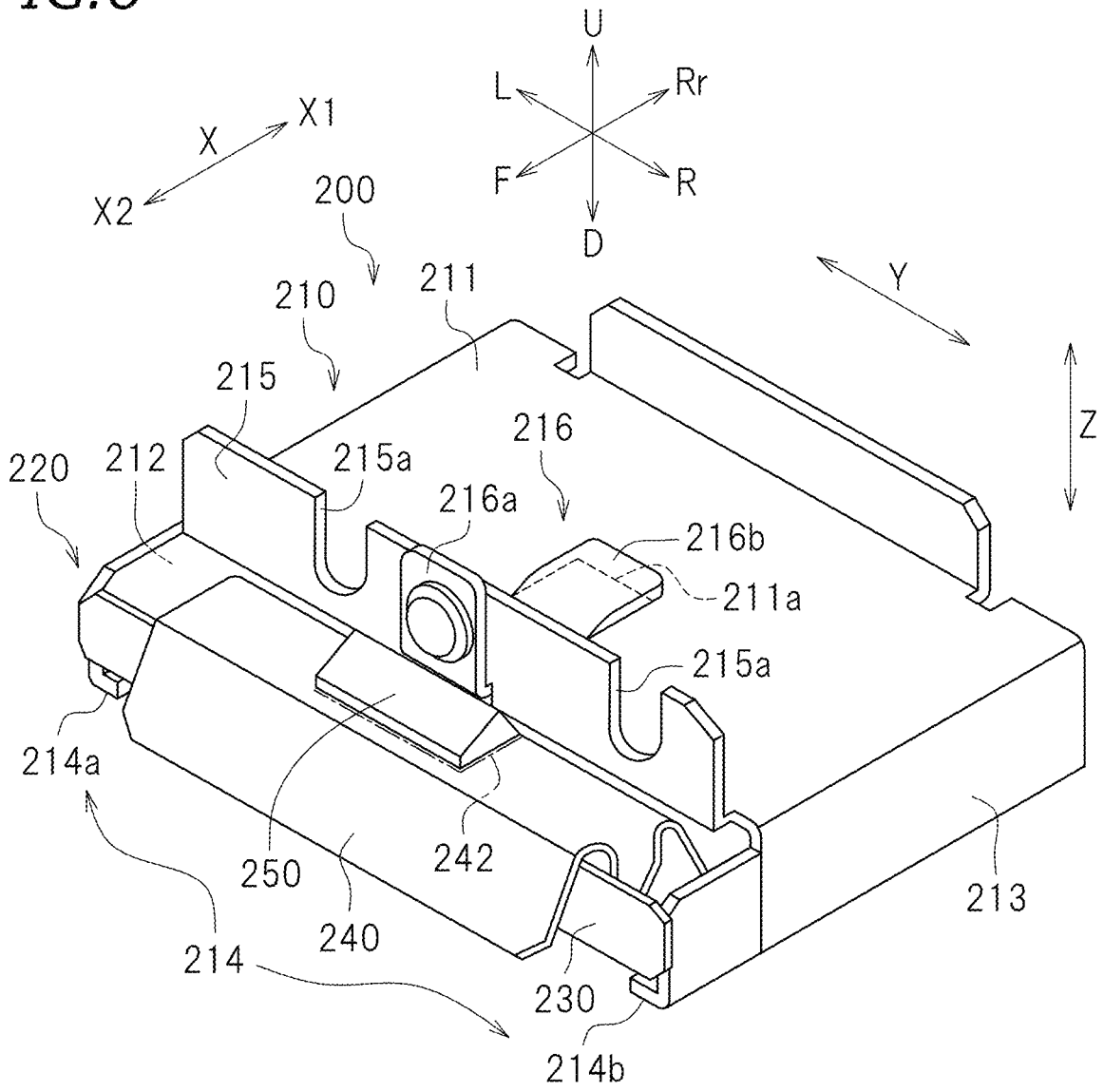
FIG. 6 is a perspective view of a wiper cleaner.
Figure 7:
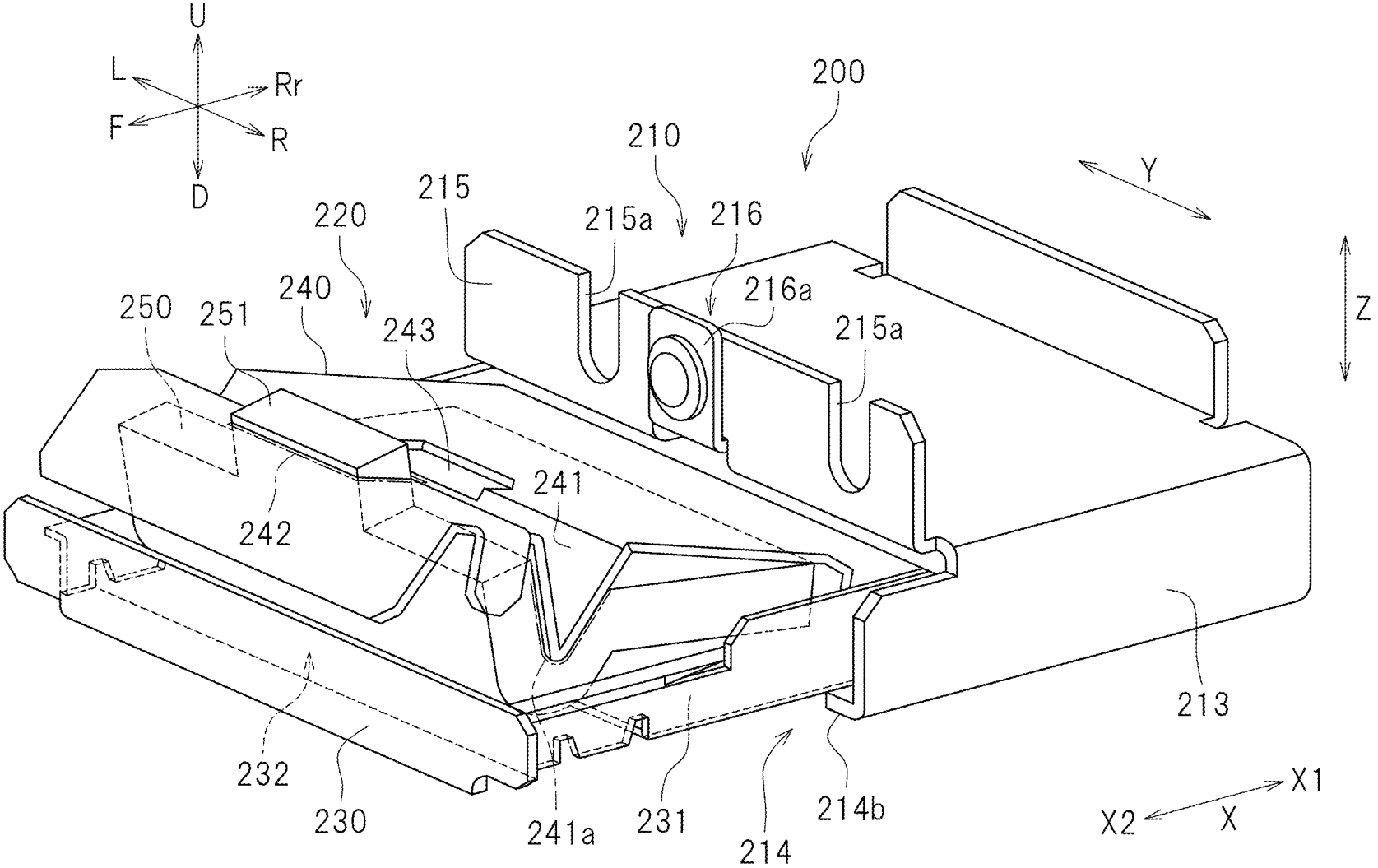
FIG. 7 is a perspective view of the wiper cleaner illustrating a state in which an absorbent assembly is pulled out from a case.

FIG. 6 is a perspective view of the wiper cleaner 200. As illustrated in FIG. 6, the wiper cleaner 200 includes a case 210 and an absorbent assembly 220. FIG. 7 is a perspective view of the wiper cleaner 200 illustrating a state in which the absorbent assembly 220 has been pulled out from the case 210. The absorbent assembly 220 is able to be inserted in the case 210 or be pulled out from the case 210 by sliding the absorbent assembly 220 in the moving direction X of the wiper 110.

The case 210 is formed into a box shape having an opened lower side and opened sides in the front-rear direction. As illustrated in FIG. 6, the case 210 includes a top plate 211, a left plate 212, and a right plate 213. The case 210 has a substantially inverted U-shape that opens downwardly when viewed in the moving direction X of the wiper 110.

A guide 214 is provided in a bottom opening of the case 210. The guide 214 includes a left guide 214*a* projecting inwardly (rightwardly) in the case 210 from a lower end of the left plate 212 and a right guide 214*b* projecting inwardly (leftwardly) in the case 210 from a lower end of the right plate 213. The left guide 214*a* extends along the lower end of the left plate 212 in the moving direction X of the wiper 110. The right guide 214*b* extends along the lower end of the right plate 213 in the moving direction X of the wiper 110. The guide 214 is a lower side guide when the absorbent assembly 220 is inserted in the case 210 by sliding the absorbent assembly 220 in the moving direction X. The guide 214 also defines and functions as a regulator that regulates downward movement of the absorbent assembly 220 relative the case 210. When the absorbent assembly 220 is inserted in the case 210, the absorbent assembly 220 abuts on an upper surface of the guide 214 as the regulator. Thus, downward movement of the absorbent assembly 220 to a position below the guide 214 is regulated.

When the absorbent assembly 220 is inserted in the case 210 by sliding the absorbent assembly 220 in the moving direction X, the top plate 211 functions as an upper side guide. The top plate 211 also serves a second regulator that regulates upward movement of the absorbent assembly 220 relative to the case 210. When the absorbent assembly 220 is inserted in the case 210, the absorbent assembly 220 abuts on a lower surface of the top plate 211 as the second regulator. Thus, upward movement of the absorbent assembly 220 to above the top plate 211 is regulated.

An attaching plate 215 is provided in the top plate 211. The attaching plate 215 extends upwardly from a front end of the top plate 211. When the case 210 is attached to the printer 10, the attaching plate 215 is fixed to the printer 10. Two elongated holes 215*a* are provided in the attaching plate 215. The two elongated holes 215*a* are provided in a line in the width direction Y. Each of the elongated holes 215*a* passes through the attaching plate 215 in the moving direction X. Each of the elongated holes 215*a* has a flat shape that is long in the up-down direction. An upper end of each of the elongated holes 215*a* reaches an upper end of the attaching plate 215. Each of the elongated holes 215*a* is an upward cutout. A bolt 101 (see FIG. 5) used to fix the case 210 to the printer 10 is inserted in each of the elongated holes 215*a*. The bolt 101 is fastened to the printer 10 to press a portion around the long hole 215*a*, so that the case 210 is fixed to the printer 10.

A latch 216 is provided in the attaching plate 215. The latch 216 has a plate shape bent approximately at a right angle in the middle. The latch 216 includes an attaching portion 216*a* that extends in the up-down direction and a latch portion 216*b* that extends in the moving direction X of the wiper 110. The attaching portion 216*a* is fixed to the attaching plate 215. The latch portion 216*b* extends along an upper surface of the top plate 211 from a lower end of the attaching portion 216*a* in the first moving direction X1. As illustrated in FIG. 5, the latch portion 216*b* has a curved portion 216*b*1 bent so as to wave downwardly. As illustrated in FIG. 6, in the top plate 211, a latch hole 211*a* is provided in a portion corresponding to the curved portion 216*b*1. The curved portion 216*b*1 projects inwardly in the case 210 from the latch hole 211*a* of the top plate 211. The latch 216 includes a metal plate or the like and has elasticity.

The absorbent assembly 220 includes an absorbent 250 that absorbs the ink into a predetermined shape. The absorbent 250 absorbs the inks. The absorbent assembly 220 is able to be inserted in the case 210 from a front opening of the case 210. The absorbent assembly 220 includes a first member 230, a second member 240, and the absorbent 250.

The first member 230 has a box shape having an opened upper side. As illustrated in FIG. 5 and FIG. 7, an opening 232 is located in a bottom surface 231 of the first member 230. The opening 232 is a flat through hole and extends in the width direction Y of the wiper 110. A length of the opening 232 in the width direction Y is longer than a length of the wiper 110 in the width direction Y. The length of the opening 232 in the moving direction X is set to twice or about twice a thickness of the absorbent 250.

The second member 240 is provided over the first member 230. The second member 240 has a plate shape a portion of which is bent. The second member 240 is able to turn over the first member 230. As illustrated in FIG. 5, the absorbent assembly 220 includes a shaft 221 that causes the second member 240 to turn therearound. The shaft 221 is provided in a rear end of the first member 230. The shaft 221 extends in the width direction Y. A rear end of the second member 240 is connected to the shaft 221. The first member 230 and the second member 240 are turnably connected to each other via the shaft 221.

The second member 240 includes a projecting portion 241 that downwardly projects. The projecting portion 241 is a portion of the second member 240 which is bent to downwardly project. The projecting portion 241 is opposed to the opening 232 when the second member 240 is opposed to the first member 230. The projecting portion 241 includes a tip portion 241*a*. A length of the tip portion 241*a* in the moving direction X decreases in the projection direction of the projecting portion 241 (in the downward direction in this preferred embodiment) when viewed in the width direction Y. When viewed in the width direction Y, the projecting portion 241 has a shape including two sides of a triangle one of apexes of which is the tip portion 241*a*. A position of the apex of the tip portion 241*a* in the moving direction X matches a centerline of the opening 232 in the moving direction X. The projecting portion 241 extends in the width direction Y of the wiper 110 with this cross-sectional shape maintained. A length of the projecting portion 241 in the width direction Y is the same as or slightly shorter than the length of the opening 232 in the width direction Y.

There is no particular limitation on an angle of the tip portion 241*a*. The angle of the tip portion 241*a* may be appropriately set, for example, in accordance with a hardness or a thickness of the absorbent 250, a length of the opening 232 in the moving direction X (a length in a lateral direction), a hardness or a thickness of the wiper 110, or the like.

As illustrated in FIG. 6, an absorbent insertion hole 242 is located in the second member 240. The absorbent insertion hole 242 is located in a position further forward than the projecting portion 241. The absorbent insertion hole 242 is a rectangular hole that passes through the second member 240. An insertion portion 251 of the absorbent 250 is inserted in the absorbent insertion hole 242. This will be described later.

As illustrated in FIG. 7, a latch receiving portion 243 is provided in the second member 240. The latch receiving portion 243 is provided behind of the projecting portion 241. The latch receiving portion 243 is a rectangular hole that passes through the second member 240. When the absorbent assembly 220 is attached to the case 210, the curved portion **216*b*1 of the latch 216 engages the latch receiving portion 243**. This will be also described later.

The absorbent 250 is formed of a material that can absorb inks and has flexibility. A material having a resistance to the inks is preferably used for the absorbent 250. The absorbent 250 is, for example, a porous sponge. In a case in which the absorbent 250 is used for some other device than an ink jet printer, the absorbent 250 may absorb a liquid ejected by a liquid ejection head.

Figure 8:
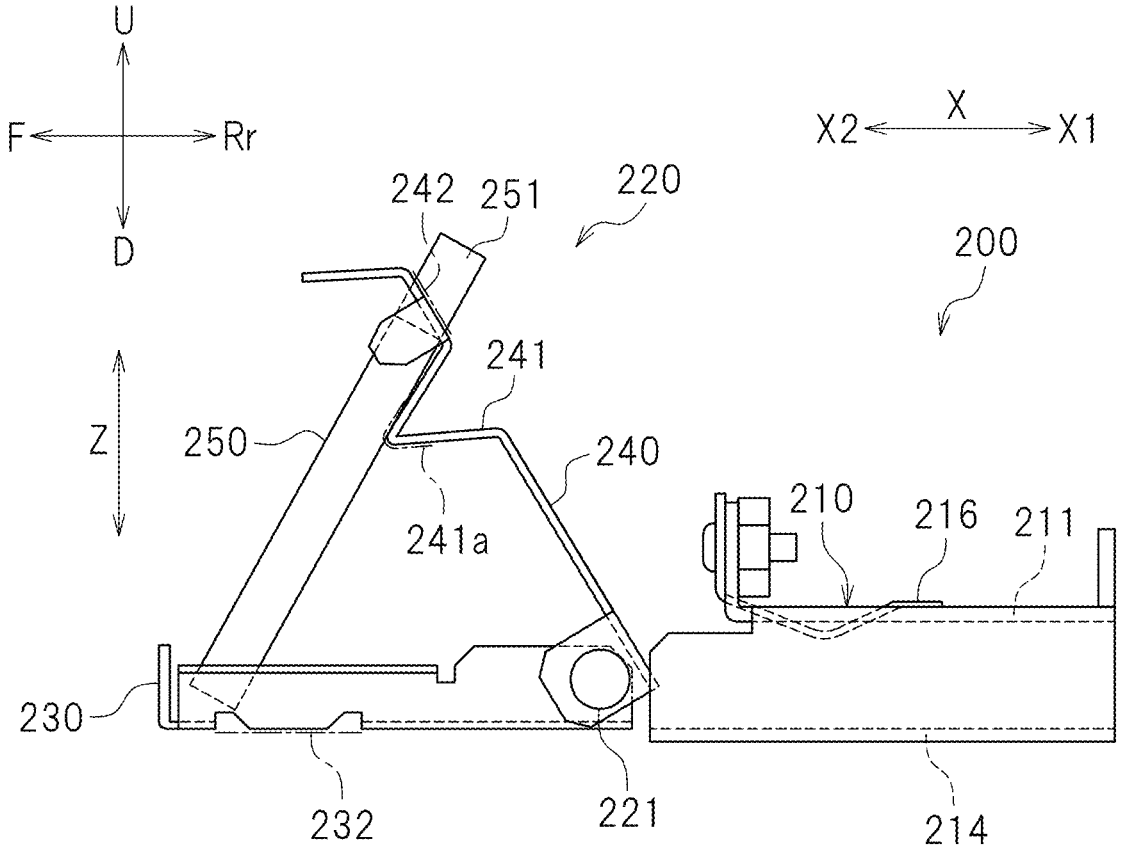
FIG. 8 is a side view of the wiper cleaner illustrating a state in which the absorbent is attached to the second member.
Figure 9:
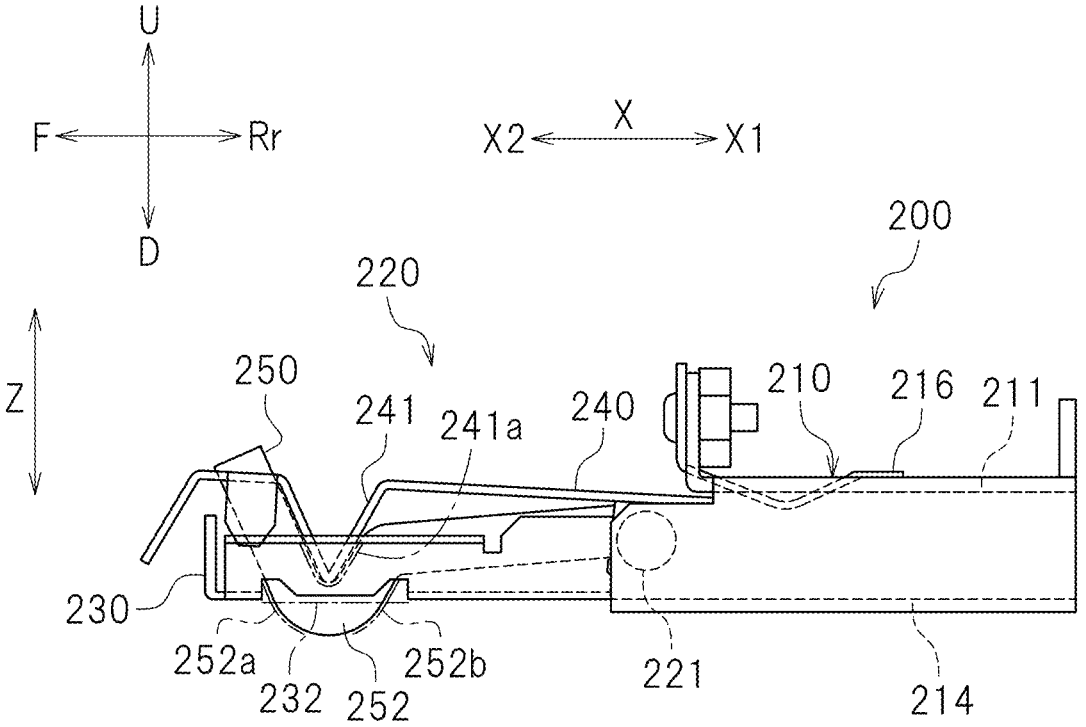
FIG. 9 is a side view of the wiper cleaner illustrating a state in which the second member is turned from the state of FIG. 8 and the absorbent is caused to adhere to the first member.

The absorbent 250 is preferably made of a material having a plate shape. In a state in which the absorbent 250 is attached to the absorbent assembly 220, the absorbent 250 is deformed. A length of the absorbent 250 in the width direction Y is longer than the length of the wiper 110 in the width direction Y. The length of the absorbent 250 in the width direction Y is shorter than the lengths of the opening 232 and the projecting portion 241 in the width direction Y. Accordingly, the absorbent 250 is able to be inserted through the opening 232. As illustrated in FIG. 7, the absorbent 250 includes the insertion portion 251. A length of the insertion portion 251 in the width direction Y is smaller than the length of the other portion of the absorbent 250 in the width direction Y. The insertion portion 251 protrudes forward from a front side surface of the absorbent 250. FIG. 8 and FIG. 9 are side views schematically illustrating steps of attaching the absorbent 250 to the first member 230 and the second member 240. FIG. 8 illustrates a state in which the absorbent 250 is attached to the second member 240. FIG. 9 illustrates a state in which the second member 240 has turned from the state of FIG. 8 and the absorbent 250 adheres to the first member 230. As illustrated in FIG. 8, the insertion portion 251 is inserted in the absorbent insertion hole 242, and thus, the absorbent 250 is attached to the second member 240.

When the absorbent 250 is removed, the second member 240 is moved from a position opposed to the first member 230 illustrated in FIG. 5 or the like. Specifically, the second member 240 is caused to turn around the shaft 221 such that a front end of the second member 240 is separated from a front end of the first member 230 and is moved to a position illustrated in FIG. 8. This state will be hereinafter referred to as a state in which "the second member 240 is opened" and putting the second member 240 in this state will be referred to as "opening the second member 240". As illustrated in FIG. 8, the absorbent 250 is attached to the second member 240 in the state in which the second member 240 is opened. The state in which the second member 240 is opened is a state in which the absorbent 250 is attachable to and removable from the first member 230 and the second member 240.

As illustrated in FIG. 9, when the second member 240 downwardly turns from the state of FIG. 8, the absorbent 250 is sandwiched between the first member 230 and the second member 240. A state in which the second member 240 is substantially horizontally disposed and is opposed to the first member 230 will be referred to as a state in which "the second member 240 is closed" and putting the second member 240 in this state will be referred to as "closing the second member 240". The second member 240 is caused to turn about the shaft 221 as a center, and is moved between a position in which the second member 240 presses the absorbent 250 (see FIG. 9) and a position in which the second member 240 releases the absorbent 250 (see FIG. 8). As illustrated in FIG. 9, in a state in which the second member 240 is closed, the absorbent 250 is disposed between the first member 230 and the second member 240. At this time, the projecting portion 241 of the second member 240 contacts a portion of the absorbent 250, specifically, a portion of the absorbent 250 which is located over the opening 232 from above.

As illustrated in FIG. 9, when the second member 240 is downwardly pressed in a state in which the second member 240 is closed, the absorbent 250 is sandwiched between the first member 230 and the second member 240 and thus is deformed. When the second member 240 is pressed toward the first member 230, the projecting portion 241 of the second member 240 presses the absorbent 250 toward the opening 232 of the first member 230. Thus, a portion of the absorbent 250 which is sandwiched between the projecting portion 241 and the opening 232 is pressed by the projecting portion 241 and is thus deformed. Specifically, the portion is deformed to have a shape downwardly projecting so as to copy a shape of the projecting portion 241. As a result, the portion of the absorbent 250 which is sandwiched between the projecting portion 241 and the opening 232 partially protrudes in the projection direction of the projecting portion 241 (in the downward direction in this preferred embodiment) from the opening 232 to form a protruding portion 252. The protruding portion 252 is a portion of the absorbent 250 which downwardly protrudes below the opening 232 of the first member 230.

The second member 240 is pressed toward the first member 230 by the top plate 211 of the case 210. The top plate 211 functions as a presser that presses the second member 240 toward the first member 230. The second member 240 is pressed toward the first member 230 by the top plate 211 as a presser, and presses the absorbent 250 toward the first member 230.

When the absorbent assembly 220 is inserted in the case 210 by sliding the absorbent assembly 220, an upper surface of the second member 240 abuts on the lower surface of the top plate 211. At this time, the second member 240 turns in a direction in which the second member 240 is closed while deforming the absorbent 250. The first member 230 abuts on the guide 214 provided in a lower end of the case 210 and downward movement of the first member 230 is regulated. The second member 240 presses the absorbent 250 to deform the absorbent 250 in a state in which the first member 230 abuts on the guide 214 and the second member 240 abuts on the top plate 211. The top plate 211 itself does not move but functions as a presser that presses and deforms the absorbent 250 by pressing back a restoring force generated by deformation of the absorbent 250.

As the absorbent assembly 220 is inserted in the case 210, the curved portion **216*b*1 of the latch 216 engages the latch receiving portion 243 of the second member 240. The latch 216 engages the latch receiving portion 243, and thus, a user recognizes that the absorbent assembly 220 is properly attached to the case 210. The latch 216 fixes the absorbent assembly 220 to the case 210, and thus, the absorbent assembly 220 does not easily drop from the case 210. However, when the absorbent assembly 220 is pulled out in the second moving direction X2, the latch 216 is easily removed from the latch receiving portion 243. Accordingly, the user can easily attach and remove the absorbent assembly 220 to and from the case 210**.

When the absorbent 250 is attached to the absorbent assembly 220 in the above described manner, a portion of the absorbent 250 forms the protruding portion 252 that downwardly protrudes below a lower surface of the case 210. As illustrated in FIG. 5, the wiper 110 is provided below the opening 232 of the wiper cleaner 200. Also, the wiper 110 is provided at a height at which an upper portion of the wiper 110 contacts the protruding portion 252 of the absorbent 250. A height of the upper end of the wiper 110 is lower than at least the opening 232 and higher than a tip end (a lower end) of the protruding portion 252. The wiper mover 130 moves the wiper 110 such that the wiper 110 contacts the protruding portion 252 of the absorbent 250.

As illustrated in FIG. 5, the protruding portion 252 includes the two cleaning surfaces 252*a* and 252*b* that face in the moving direction X of the wiper 110 and extend in the width direction Y. Of the two cleaning surfaces 252*a* and 252*b*, the first cleaning surface 252*a* faces in the second moving direction X2 and cleans a surface (which will be hereinafter referred to as a first wiper surface 110*a*) of the wiper 110 which faces in the first moving direction X1. The second cleaning surface 252*b* faces in the first moving direction X1 and cleans a surface (which will be hereinafter referred to as a second wiper surface 110*b*) of the wiper 110 which faces in the second moving direction X2.

As illustrated in FIG. 5, the first cleaning surface 252*a* is inclined in the first moving direction X1 (the rearward direction) toward the protruding direction of the protruding portion 252 (a downward direction in this preferred embodiment). The first cleaning surface 252*a* is inclined downwardly toward the rear. The second cleaning surface 252*b* is inclined in the second moving direction X2 (the forward direction) toward the protruding direction of the protruding portion 252 (the downward direction in this preferred embodiment). The second cleaning surface 252*b* is inclined downwardly toward the front. As described above, the centerline of the opening 232 in the moving direction X and a position of the tip portion 241*a* of the projecting portion 241 in the moving direction X match each other in a state in which the second member 240 is closed. Accordingly, the first cleaning surface 252*a* and the second cleaning surface 252*b* are formed into shapes approximately symmetrical to each other about the centerline of the opening 232. The first cleaning surface 252*a* and the second cleaning surface 252*b* are formed so as to be slightly curved. More specifically, the first cleaning surface 252*a* defines a curved surface projecting toward the second moving direction X2, and the second cleaning surface 252*b* defines a curved surface projecting toward the first moving direction X1.

An amount of contact of the protruding portion 252 and the wiper 110, in other words, a gap between the upper end of the wiper 110 and the opening 232, is adjusted by the elongated holes 215*a* provided in the attaching plate 215 of the case 210. As illustrated in FIG. 5, the wiping assembly 100 includes a tap 102 to which the bolt 101 used to fix the wiper cleaner 200 is fastened. The bolt 101 is inserted through the corresponding long hole 215*a* and then is fastened to the tap 102. The wiper cleaner 200 is movable in the up-down direction in a range of the elongated holes 215*a* in a state in which the bolts 101 are not fastened up. Thus, the gap between the upper end of the wiper 110 and the opening 232 is adjusted. However, a mechanism that adjusts the gap between the upper end of the wiper 110 and the opening 232 is not limited thereto. It is sufficient that a position adjuster that adjusts the gap between the upper end of the wiper 110 and the opening 232 is configured to be able to move the wiper 110 or the wiper cleaner 200 in the protruding direction of the protruding portion 252 and a direction opposite to the projection direction, and there is no further limitation on the position adjuster. For example, the position adjuster may adjust a height of the wiper 110. A height adjuster is not limited to a long hole, and a height adjuster using a screw that is inserted in the up-down direction and moves in the up-down direction when being rotated may be used.

When the ink heads 50 are wiped by the wiper 110, the carriage 30 is moved on a moving path of the wiper 110. There is no particular limitation on a process of wiping but, for example, in one preferred process, the wiper 110 is first moved to a position farther in the second moving direction X2 (the forward direction) than the guide rail 41. Thereafter, the carriage 30 is moved to a position behind the wiping assembly 100. Thus, the ink heads 50 are located on the moving path of the wiper 110. From this state, the wiper 110 is moved in the first moving direction X1. A position of the upper end of the wiper 110 is set slightly above the nozzle surfaces 50*a* of the ink heads 50. Accordingly, a portion of the wiper 110 which is located near the upper end contacts the nozzle surfaces 50*a* of the ink heads 50 due to movement of the wiper 110. In accordance with the above described process, mainly, the first wiper surface 110*a* of the wiper 110 wipes the nozzle surfaces 50*a*. By this wiping of the nozzle surfaces 50*a*, the inks adhere to the first wiper surface 110*a*. Moreover, there is a probability that the inks also flow onto the second wiper surface 110*b* and adhere thereto.

Unless the inks that have adhered to the wiper 110 are removed, the inks are solidified on a surface of the wiper 110. Thus, a state of the wiper 110 is likely to be deteriorated, thus resulting in reduction in wiping quality. Therefore, the inks that have adhered to the wiper 110 are removed by the wiper cleaner 200.

In cleaning of the wiper 110, the wiper 110 is moved by the wiper mover 130 to contact the wiper cleaner 200. The wiper 110 is located in a position farther in the second moving direction X2 than the protruding portion 252 of the wiper cleaner 200 when wiping is completed. From this state, the wiper mover 130 moves the wiper 110 in the first moving direction X1. Thus, the first wiper surface 110*a* of the wiper 110 can be brought into contact with the first cleaning surface 252*a* of the wiper cleaner 200.

When the wiper 110 and the protruding portion 252 of the absorbent 250 contact each other, the inks in a contact portion of the wiper 110 and the protruding portion 252 are absorbed by the absorbent 250. Thus, the inks that have adhered to the wiper 110 are removed.

In this preferred embodiment, the protruding portion 252 has a stereoscopic shape projecting downward. Accordingly, the first wiper surface 110*a* that is a surface of the wiper 110 to be wiped and the protruding portion 252 face each other along the moving direction X of the wiper 110, and the first wiper surface 110*a* is preferably cleaned. In the wiping assembly 100 according to this preferred embodiment, the absorbent 250 having a plate shape can be formed into a projecting stereoscopic shape suitable for cleaning of the wiper 110 very easily.

Furthermore, in this preferred embodiment, the first cleaning surface 252*a* of the protruding portion 252 has a shape that is downwardly inclined toward the first moving direction X1. When the flexible wiper 110 contacts the first cleaning surface 252*a*, the wiper 110 is curved along an inclination of the first cleaning surface 252*a*. Thus, contact of the first wiper surface 110*a* and the protruding portion 252 is made even better and cleaning quality of the first wiper surface 110*a* is increased. A resistance received by the wiper 110 from the protruding portion 252 when the wiper 110 is moved is able to be reduced.

Thereafter, the wiper 110 is moved to a position farther in the first moving direction X1 than the protruding portion 252. At a time when cleaning of the first wiper surface 110*a* is completed, the wiper 110 is located in a position farther in the first moving direction X1 than the protruding portion 252 of the wiper cleaner 200. From this state, the wiper mover 130 moves the wiper 110 in the second moving direction X2. Thus, the second wiper surface 110*b* of the wiper 110 is brought into contact with the second cleaning surface 252*b* of the wiper cleaner 200. The printer 10 cleans the second wiper surface 110*b* that is a back surface of the first wiper surface 110*a* while moving the wiper 110 back in the second moving direction X2. The wiping assembly 100 according to this preferred embodiment cleans both of the first wiper surface 110*a* and the second wiper surface 110*b* of the wiper 110 by the above described processes.

Note that the insertion portion 251 of the absorbent 250 which is exposed through the absorbent insertion hole 242 also functions as an indicator used to check a state of the absorbent 250. The insertion portion 251 of the absorbent 250 is exposed to outside via the absorbent insertion hole 242 of the second member 240. When the inks are absorbed by the absorbent 250 to a nearly saturated state, colors of the inks appear in the insertion portion 251. The user can visually recognize the state of the absorbent 250 by the exposed insertion portion 251.

As described above, the wiper cleaner 200 according to this preferred embodiment includes the first member 230 in which the opening 232 is located, the second member 240 including the projecting portion 241 opposed to the opening 232, and the absorbent 250 preferably made of a material having a plate shape and disposed between the first member 230 and the second member 240, and the second member 240 is pressed toward the first member 230 by the top plate 211 as a presser. Thus, the projecting portion 241 of the second member 240 presses the absorbent 250 toward the opening 232 of the first member 230, and at least a portion of the absorbent 250 is deformed to form the protruding portion 252 that protrudes in the projection direction of the projecting portion 241 from the opening 232 by pressing by the projecting portion 241. According to the above described configuration, the absorbent 250 having a plate shape can be easily formed into a projecting stereoscopic shape that is suitable to clean of the wiper 110.

According to this preferred embodiment, the wiper cleaner 200 is provided in a line with the wiper 110 in the moving direction X perpendicular to the width direction Y of the wiper 110, and the opening 232 and the projecting portion 241 extend in the width direction Y. Therefore, the cleaning surfaces 252*a* and 252*b* that face in the moving direction X and extend in the width direction Y are provided in the protruding portion 252. According to this configuration, the wiper surfaces 110*a* and 110*b* of the wiper 110 and the cleaning surfaces 252*a* and 252*b* of the absorbent 250 face each other along the moving direction X. Accordingly, the wiper surfaces 110*a* and 110*b* are able to be cleaned well.

Furthermore, in this preferred embodiment, the wiper mover 130 moves the wiper 110 in the first moving direction X1 from a state in which the wiper 110 is disposed in a position farther in the second moving direction X2 than the protruding portion 252 to bring the first wiper surface 110*a* into contact with the first cleaning surface 252*a*. The wiper mover 130 also moves the wiper 110 in the second moving direction X2 from a state in which the wiper 110 is disposed in a position farther in the first moving direction X1 than the protruding portion 252 to bring the second wiper surface 110*b* into contact with the second cleaning surface 252*b*. The first cleaning surface 252*a* is inclined in the first moving direction X1 toward the protruding direction of the protruding portion 252, and the second cleaning surface 252*b* is inclined in the second moving direction X2 toward the protruding direction of the protruding portion 252. According to this configuration, both surfaces (the first wiper surface 110*a* and the second wiper surface 110*b*) of the wiper 110 are able to be cleaned. Furthermore, according to this configuration, the wiper 110 is bent along the cleaning surfaces 252*a* and the 252*b*, and therefore, the wiper surfaces 110*a* and 110*b* are able to be brought into good contact with the cleaning surfaces 252*a* and 252*b*, respectively, and cleaning quality is increased. A resistance received by the wiper 110 from the protruding portion 252 when the wiper 110 is moved is able to be reduced.

In this preferred embodiment, the projecting portion 241 of the second member 240 includes the tip portion 241*a* the length in the moving direction X of which decreases in the projection direction of the projecting portion 241 when viewed in the width direction Y. The tip portion 241*a* has a predetermined angle herein. According to this configuration, inclined surfaces of the first cleaning surface 252*a* and the second cleaning surface 252*b* are able to be easily formed. The angle of the tip portion 241*a* may be an acute angle. As another option, the angle of the tip portion 241*a* may be a right angle or an obtuse angle.

When the angle of the tip portion 241*a* is set to an acute angle, each of inclinations of the first cleaning surface 252*a* and the second cleaning surface 252*b* is closer to vertical, and the first wiper surface 110*a* and the second wiper surface 110*b* can be made to relatively strongly abut on the first cleaning surface 252*a* and the second cleaning surface 252*b*, respectively. Thus, the first wiper surface 110*a* and the second wiper surface 110*b* are able to be more strongly wiped.

On the other hand, when the angle of the tip portion 241*a* is set to a right angle or an obtuse angle, each of the inclinations of the first cleaning surface 252*a* and the second cleaning surface 252*b* is closer to horizontal, and the first wiper surface 110*a* and the second wiper surface 110*b* can be made to relatively weakly abut on the first cleaning surface 252*a* and the second cleaning surface 252*b*, respectively. Thus, resistances received by the first wiper surface 110*a* and the second wiper surface 110*b* from the first cleaning surface 252*a* and the second cleaning surface 252*b*, respectively, are able to be reduced. The angle of the tip portion 241*a* may be appropriately set, for example, in accordance with a hardness or a thickness of the absorbent 250, a length of the opening 232 in the moving direction X (a length in a lateral direction), a hardness or a thickness of the wiper 110, or the like.

The wiping assembly 100 according to this preferred embodiment incudes the position adjuster to be able to move the wiper cleaner 200 in the protruding direction of the protruding portion 252 and a direction opposite to the protruding direction. Thus, a condition of contact of the wiper 110 and the protruding portion 252 can be adjusted. Note that, as described above, the position adjuster is not limited to a position adjuster that adjusts the position of the wiper cleaner 200. The position adjuster may adjust the position of the wiper 110.

In this preferred embodiment, the top plate 211 as a presser that presses the second member 240 and the second member 240 are configured to be separable from each other. Herein, when the absorbent assembly 220 is pulled out from the case 210, the top plate 211 is separated from the second member 240. When the top plate 211 as a presser is separated from the second member 240, the absorbent 250 is attachable to and removable from the first member 230 and the second member 240. That is, the absorbent 250 is not pressed by the presser, and therefore, the absorbent 250 can be attached to and removed from the first member 230 and the second member 240. According to this configuration, the absorbent 250 can be exchanged as a consumable. An access to the absorbent 250 is made from the second member 240 (an upper side in this preferred embodiment) and exchanging work is easy.

The wiper cleaner 200 includes the shaft 221 as a member that causes the second member 240 to hold or release the absorbent 250. The shaft 221 is able to cause the second member 240 to turn. The second member 240 turns around the shaft 221 as a center, and thus, moves between a position in which the second member 240 presses the absorbent 250 and a position in which the second member 240 releases the absorbent 250. According to this configuration, the first member 230 and the second member 240 are not separated from each other, and pressing work or releasing work for the absorbent 250 are easy. However, the wiper cleaner 200 may not have the above described configuration. For example, the second member 240 may be completely separated from the first member 230.

The case 210 according to this preferred embodiment includes the guide 214 as a regulator. The guide 214 abuts on the first member 230 and regulates movement of the first member 230 in the protruding direction of the protruding portion 252 (the downward direction in this preferred embodiment). The top plate 211 as a presser is able to abut on the second member 240 and regulate movement of the second member 240 in an opposite direction to the protruding direction of the protruding portion 252 (an upward direction in this preferred embodiment). The second member 240 presses and thus deforms the absorbent 250 in a state in which the first member 230 abuts on the guide 214 and the second member 240 abuts on the top plate 211. According to this configuration, the presser does not need to include a moving portion and a driving portion, and the configuration is simple.

Furthermore, in this preferred embodiment, the guide 214 as a regulator and the top plate 211 serve as guides that cause the absorbent assembly 220 to slide. In this preferred embodiment, the guide 214 is able to guide the first member 230 to slide in a sliding direction perpendicular to the protruding direction of the protruding portion 252, and the top plate 211 is able to guide the second member 240 to slide in the sliding direction. The first member 230 and the second member 240 slide in the sliding direction to be attached to and removed from the wiper cleaner 200. Note that the above described "sliding direction" is the moving direction X in this preferred embodiment but may be any direction perpendicular to the protruding direction of the protruding portion 252. According to this configuration, the first member 230 and the second member 240 can be easily attached to and removed from the wiper cleaner 200 by sliding the first member 230 and the second member 240.

Preferred embodiments have been described above. However, printers disclosed herein are not limited to the above described preferred embodiments.

For example, in the above described preferred embodiments, the wiper 110 is moved and the wiper cleaner 200 is immovable. However, the wiper 110 and the wiper cleaner 200 are moved relative to each other and which one of the wiper 110 and the wiper cleaner 200 is moved is not limited. For example, the wiper cleaner may be moved and both of the wiper and the wiper cleaner may be moved. As long as the wiper and the wiper cleaner are configured to be contactable to each other, there is no particular limitation on the arrangement of the wiper and the wiper cleaner.

In the above described preferred embodiment, the protruding portion 252 has the first cleaning surface 252*a* that is downwardly inclined toward the first moving direction X1 and extends in the width direction Y. But the second cleaning surface 252*b* that is downwardly inclined toward the second moving direction X2 and extends in the width direction Y but the protruding portion 252 is not limited to the above described shape. Cleaning of the wiper may be performed only on one of the wiper surfaces, and the protruding portion may have only one cleaning surface. The cleaning surface may not be necessarily inclined. There is no particular limitation on a shape of the protruding portion 252.

Furthermore, in the above described preferred embodiment, the top plate 211 as the presser is not configured to actively press the second member 240, and only receives a repulsive force of the absorbent 250. However, the presser may actively press the second member. The presser may include, for example, an elastic body or the like.

In the above described preferred embodiments, the printers 10 are flatbed printers, but there is no limitation on a configuration of the printers. For example, the technology disclosed herein may be applied to a printer of a type in which a recording medium is supplied from a roll.

Furthermore, the technology disclosed therein can be used for not only a printer but also some other device including a liquid ejection head. For example, the technology disclosed herein may be used for a three-dimensional molding device that ejects a sclerosing solution from a liquid ejection head, or the like.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This invention should be regarded as providing preferred embodiments of the principles of the present invention. These preferred embodiments are provided with the understanding that they are not intended to limit the present invention to the preferred embodiments described in the specification and/or shown in the drawings. The present invention is not limited to the preferred embodiments and encompasses any of preferred embodiments including equivalent elements, modifications, deletions, combinations, improvements and/or alterations which can be recognized by a person of ordinary skill in the art based on the present invention. The elements of each claim should be interpreted broadly based on the terms used in the claim, and should not be limited to any of the preferred embodiments described in this specification or referred to during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A wiping assembly comprising:

a wiper to wipe a liquid ejection head;

a wiper cleaner; and a mover to move the wiper relative to the wiper cleaner; wherein the wiper cleaner incudes:

a first member in which an opening is provided;

a second member including a projecting portion opposed to the opening;

an absorbent that has a plate shape and is disposed between the first member and the second member; and a presser to press the second member toward the first member;

the absorbent is made of a material that is able to absorb a liquid ejected by the liquid ejection head and is flexible;

the projecting portion presses the absorbent toward the opening of the first member in a state in which the second member is pressed by the presser;

at least a portion of the absorbent is deformed to provide a protruding portion that protrudes in a projection direction of the projecting portion from the opening by pressing by the projecting portion; and the mover moves the wiper such that the wiper contacts the protruding portion of the absorbent.

2. The wiping assembly according to claim 1, wherein the wiper extends in a predetermined width direction;

the wiper cleaner is provided in a line with the wiper in a moving direction perpendicular or substantially perpendicular to the width direction;

the opening extends in the width direction;

the projecting portion extends in the width direction;

the protruding portion includes a cleaning surface that faces in the moving direction and extends in the width direction; and the mover moves the wiper in the moving direction to bring the wiper into contact with the cleaning surface.

3. The wiping assembly according to claim 2, wherein the wiper includes a first wiper surface that faces in a first moving direction that is one direction of the moving direction and a second wiper surface that faces in a second moving direction that is an opposite direction to the first moving direction;

the cleaning surface includes a first cleaning surface that faces in the second moving direction and a second cleaning surface that faces in the first moving direction;

the mover moves the wiper in the first moving direction from a state in which the wiper is disposed in a position farther in the second moving direction than the protruding portion to bring the first wiper surface into contact with the first cleaning surface, and moves the wiper in the second moving direction from a state in which the wiper is disposed in a position farther in the first moving direction than the protruding portion to bring the second wiper surface into contact with the second cleaning surface, the first cleaning surface is inclined in the first moving direction toward the protruding direction of the protruding portion; and the second cleaning surface is inclined in the second moving direction toward the protruding direction of the protruding portion.

4. The wiping assembly according to claim 2, wherein the projecting portion includes a tip portion; and a length of the tip portion in the moving direction decreases in the projection direction of the projecting portion when viewed in the width direction.

5. The wiping assembly according to claim 4, wherein an angle of the tip portion is an acute angle.

6. The wiping assembly according to claim 4, wherein an angle of the tip portion is a right angle or an obtuse angle.

7. The wiping assembly according to claim 1, further comprising:

a position adjuster that is able to move the wiper or the wiper cleaner in the protruding direction of the protruding portion and an opposite direction to the protruding direction.

8. The wiping assembly according to claim 1, wherein the presser is separable from the second member; and when the presser is separated from the second member, the absorbent is attachable to and removable from the first member and the second member.

9. The wiping assembly according to claim 8, wherein the wiper cleaner includes a shaft that causes the second member to turn; and the second member turns around the shaft and moves between a position in which the second member presses the absorbent and a position in which the second member releases the absorbent.

10. The wiping assembly according to claim 1, wherein the wiper cleaner includes a first regulator to abut on the first member and regulate movement of the first member in the protruding direction of the protruding portion;

the presser includes a second regulator to abut on the second member and regulate movement of the second member in an opposite direction to the protruding direction of the protruding portion; and the second member presses and deforms the absorbent in a state in which the first member abuts on the first regulator and the second member abuts on the second regulator.

11. The wiping assembly according to claim 10, wherein the first regulator is positioned to guide the first member to slide in a sliding direction perpendicular to the protruding direction of the protruding portion;

the second regulator is positioned to guide the second member to slide in the sliding direction; and the first member and the second member slide in the sliding direction to be attached to and removed from the wiper cleaner.

12. An ink jet printer comprising:

the wiping assembly according to claim 1; and a liquid ejection head configured to eject an ink.

* * * * *